United States Patent [19]

Iida

[11] Patent Number: 4,713,125

[45] Date of Patent: Dec. 15, 1987

[54] METHOD OF COOLING STEEL STRIP IN CONTINUOUS HEAT TREATING LINE

[75] Inventor: Sachihiro Iida, Kurashiki, Japan

[73] Assignee: Kawasaki Steel Corporation, Kobe, Japan

[21] Appl. No.: 842,136

[22] Filed: Mar. 20, 1986

[30] Foreign Application Priority Data

Mar. 22, 1985 [JP] Japan ..... 56093/85

[51] Int. Cl.[4] ..... C21D 11/00

[52] U.S. Cl. ..... 148/128; 148/155; 148/156

[58] Field of Search ..... 148/128, 143, 153, 155, 148/156

[56] References Cited

U.S. PATENT DOCUMENTS 4,440,583 4/1984 Ikegami et al. ..... 148/128

FOREIGN PATENT DOCUMENTS 275 1/1966 Australia .
5115 5/1966 Australia .
84659 9/1975 Australia .
12270 3/1976 Australia .
58162 5/1980 Australia .
59384 6/1980 Australia .
78958 11/1981 Australia .
90072 10/1982 Australia .
86331 8/1983 European Pat. Off. ..... 266/112

*Primary Examiner*—Christopher W. Brody
*Attorney, Agent, or Firm*—Balogh, Osann, Kramer, Dvorak, Genova & Traub

[57] ABSTRACT

The steel strip which has been cooled through a cooling zone in a continuous heat treating line is finally cooled by immersing in cooling water in a cooling tank under the controlling in accordance with the following formula:

$$l \geqq \frac{\rho \cdot Cp \cdot v \cdot d}{2\alpha} \cdot \ln\left(\frac{Ts - Tw}{120 - Tw}\right).$$

With such controlling of cooling, any dirt adhesion on the surface of the strip caused by contacting with a sink-roll is prevented.

4 Claims, 7 Drawing Figures

METHOD OF COOLING STEEL STRIP IN CONTINUOUS HEAT TREATING LINE

BACKGROUND OF THE INVENTION

1. Field of the Invention

The present invention relates to a method and an apparatus for cooling a steel strip which has been cooled through a cooling zone in a continuous heat treating line, in particular, for final cooling the strip by immersing in cooling water in a cooling tank.

2. Related Art Statement

There has been heretofore employed such method of cooling the steel strip by immersing in cooling water in a cooling tank for finally cooling the strip in the continuous heat treating line such as a continuous annealing line.

Such a cooling method is described, for example, in Japanese Patent Application Publication No. 11,931/57 wherein it is proposed that the temperature of cooling water is controlled to effect quick cooling without loss of aging characteristics and to be effectively recovered the heat energy of the steel strip by the cooling water. Further, in Japanese Patent Application Publication Nos. 11,932/57 and 11,933/57, there are disclosed cooling methods directed to saving and secondary utilization of the cooling water.

There has been however known that when the steel strip having a high temperature is cooled by immersing in cooling water in the cooling tank, the surface of the steel strip is often adhered with dirts from unknown cause.

Furthermore, it has been known that the tendency of adhering dirts to be surface of the steel strip becomes higher as in particular the temperature of the steel strip at the inlet of the cooling tank is higher and the amount of steel strip to be cooled in the cooling tank is greater.

Under the above circumstance, the conventional cooling process is therefore obliged to limit the amount of steel strip to be cooled or reduced the temperature of the steel strip at the inlet of the cooling tank in order to prevent dirts from adhering to the surface of the strip. There are however disadvantages that the limitation of the amount to be treated is resulted in reduction of productivity, on the other hand the lowering of the temperature of the steel strip at the inlet of the cooling tank and hence necessity of high cooling through the cooling zone usually arranged before the cooling tank is resulted in increment of cooling cost in the heat treating process.

An object of the present invention is to provide a method and an apparatus of finally cooling a steel strip capable of preventing dirts from adhering to the surface of the strip without the above mentioned disadvantages.

The inventor has investigated and found that (i) the dirt adhesion is often produced when the temperature of strip (Ts) at the inlet of the cooling tank, the product of the line speed (v) and the thickness of strip (d), and/or the temperature of cooling water (Tw) are high;

(ii) the compositions of the dirts are identical with the dirty suspensions in the cooling water in the cooling tank; and (iii) the dirts are adhered to only one side surface of the steel strip, which surface contacts with the surface of the sink-roll when the steel strip is wound around the sink-roll.

The inventor has further investigated and found that the surface of the steel strip is dirtied as a result in that in case of the steel strip still having a high temperature at the inlet of the cooling tank after cooling through the cooling zone in the heat treating line, the strip can not be sufficiently cooled with the cooling water in the cooling tank by the time of contacting with a first sink-roll so that a water film interposed between the surface of the sink-roll and the surface of the strip which is wound around the sink-roll is evaporated by the heat of the strip having a high temperature to deposit dirty suspensions included in the water on the surface of the strip.

The present invention bases on the above mentioned acknowledgement.

According to an aspect of the present invention, a method of cooling a steel strip which has been cooled through a cooling zone in a continuous heat treating line comprises step of cooling by immersing the strip in cooling water through around one or more sink-rolls in a cooling tank and the cooling of the steel strip immersed in the cooling water is controlled in accordance with the following formula:

$$l \geqq \frac{\rho \cdot Cp \cdot v \cdot d}{2\alpha} \cdot \ln\left(\frac{Ts - Tw}{120 - Tw}\right)$$

here, l is the cooling length from the surface of the cooling water to the first one of the sink-rolls (m)

Ts is the temperature of the steel strip at the inlet of the cooling tank (°C.)

Tw is the temperature of cooling water (°C.)

Cp is the specific heat of the steel strip (Kcal/kg°C.)

v is the feed speed of the steel strip (m/hr)

d is the thickness of the steel strip (m)

$\alpha$ is the coefficient of heat transfer (Kcal/m$^2$hr°C.)

$\rho$ is the density of the steel strip (kg/m$^3$)

According to another aspect of the present invention, an apparatus for cooling a steel strip which has been cooled through a cooling zone in a continuous heat treating line comprises a cooling tank containing cooling water, one or more sink-rolls arranged in the cooling water to guide the steel strip in the cooling tank, a guide roll provided at the inlet of the cooling tank for guiding the steel strip from the outlet of the cooling zone to the first one of the sink-rolls in the cooling water, means for supplying cooling water to the cooling tank and a controller for controlling the cooling of the steel strip in accordance with the following formula:

$$l \geqq \frac{\rho \cdot Cp \cdot v \cdot d}{2\alpha} \cdot \ln\left(\frac{Ts - Tw}{120 - Tw}\right).$$

BRIEF DESCRIPTION OF THE DRAWINGS

Further objects and advantages of the present invention will appear more fully as the following description of illustrative embodiments proceeds in view of the accompanying drawings, in which.

DESCRIPTION OF THE PREFERRED EMBODIMENTS

Figure 1:
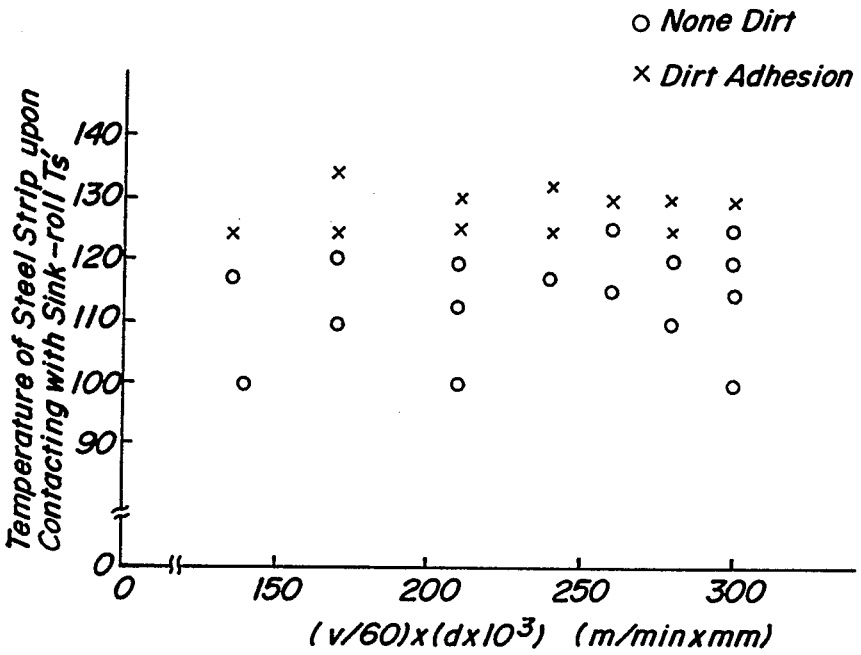
FIG. 1 is a graph showing a condition of dirt adhesion.

In order to recognize cooling conditions in case of cooling steel strip by immersing in the cooling water in a tank, the following experiments are conducted.

Each of steel strips having different thickness of 0.5 mm, 1.0 mm and 1.5 mm from each other is provided with a thermocouple and heated at a temperature on the order of 200° to 300° C. and then immersed in the cooling water in the tank 1. Table 1 shows results obtained in case of cooling by immersing the heated steel strips in the cooling water in the tank.

TABLE 1

| Thickness of steel strip (mm) | Temperature of steel strip (°C.) | Temperature of cooling water (°C.) | Coefficient of heat transfer $\alpha$ $\left(\frac{\text{Kcal}}{\text{m}^2\text{hr °C.}}\right)$ |
|---|---|---|---|
| 0.5 | 200 | 80 | 4,800 |
| | 250 | 80 | 5,300 |
| 1.0 | 200 | 75 | 5,450 |
| | 200 | 85 | 4,850 |
| 1.5 | 300 | 90 | 5,050 |
| | 250 | 85 | 5,100 |
| | 200 | 85 | 4,950 |
| | | mean coefficient of heat transfer $\alpha_1$ | 5,000 |

It will be seen from the Table 1 that in case of cooling by immersing in the cooling water in the tank, a mean coefficient of heat transfer $\alpha_1$ becomes about 5,000 (Kcal/m²hr°C.) irrespective of thickness of the steel strips and the temperature of the cooling water.

The temperature Ts' of the steel strip when the later contacts the first sink-roll 2 is represented by the following formula.

$$Ts' = Tw + (Ts - Tw)\exp\left(-\frac{2\cdot\alpha\cdot l}{\rho\cdot Cp\cdot v\cdot d}\right) \quad (1)$$

here, l is the cooling length from the surface of the cooling water to the first sink-roll (m)

Ts is the inlet temperature of a steel strip (°C.)

Ts' is the temperature of the steel strip when the later contacts the first sink-roll (°C.)

Tw is the temperature of cooling water (°C.)

Cp is the specific heat of the steel strip (Kcal/kg°C.)

v is the speed of the steel strip (m/hr)

d is the thickness of the steel strip (m)

$\alpha$ is the coefficient of heat transfer (Kcal/m²hr°C.)

$\rho$ is the density of the steel strip (kg/m³)

In order to know the condition of dirt adhesion, a number of experiments were carried out by using the above formula (1). In those experiments, the values of $\alpha$: 5,000 Kcal/m²hr°C., $\rho$: 7,850 kg/m³ and Cp: 0.124 (the mean specific heat of the steel strip in the range of temperature 250° C.–100° C.) Kcal/kg.°C. were substituted in the formula (1) as constants and the other parameters were varied. As the result of the experiments, it was found that when the temperature of strip (Tw') upon contacting with the sink-roll exceeds 120° C., the dirts adhere to the surface of the steel strip.

In the above experiments, the temperature of strip (Ts) were varied in a range of 200° to 300° C., the temperature of cooling water (Tw) were varied in a range of 70° to 90° C. and the product of (v/60) and $(d\times10^3)$ were varied in a range of 135 to 300, but in any cases of the experiments the dirts were adhered to the surface of the strip when the temperature of strip (Ts') exceeds 120° C.

In other words, there is no dirt adhesion irrespective of any other operating condition only when the temperature of strip (Ts') does not exceed 120° C.

Accordingly, the values of $Ts' \leqq 120°$ C., $\alpha=5{,}000$ Kcal/m²hr°C. and $\rho=7{,}850$ kg/m³ are substituted to the above formula (1) to obtain the following formula (2);

$$120°\text{ C.} \geqq Tw + (Ts - Tw)\exp\left(-\frac{10{,}000l}{7{,}850\cdot Cp\cdot v\cdot d}\right) \quad (2)$$

The formula (2) can be rewritten as follows:

$$l \geqq \frac{7850\cdot Cp\cdot vd}{10{,}000}\, l_n\left(\frac{Ts - Tw}{120 - Tw}\right) \quad (3)$$

Accordingly, when the cooling of the steel strip is controlled so as to satisfy the formula (3), there is no dirt adhesion.

Figure 2:
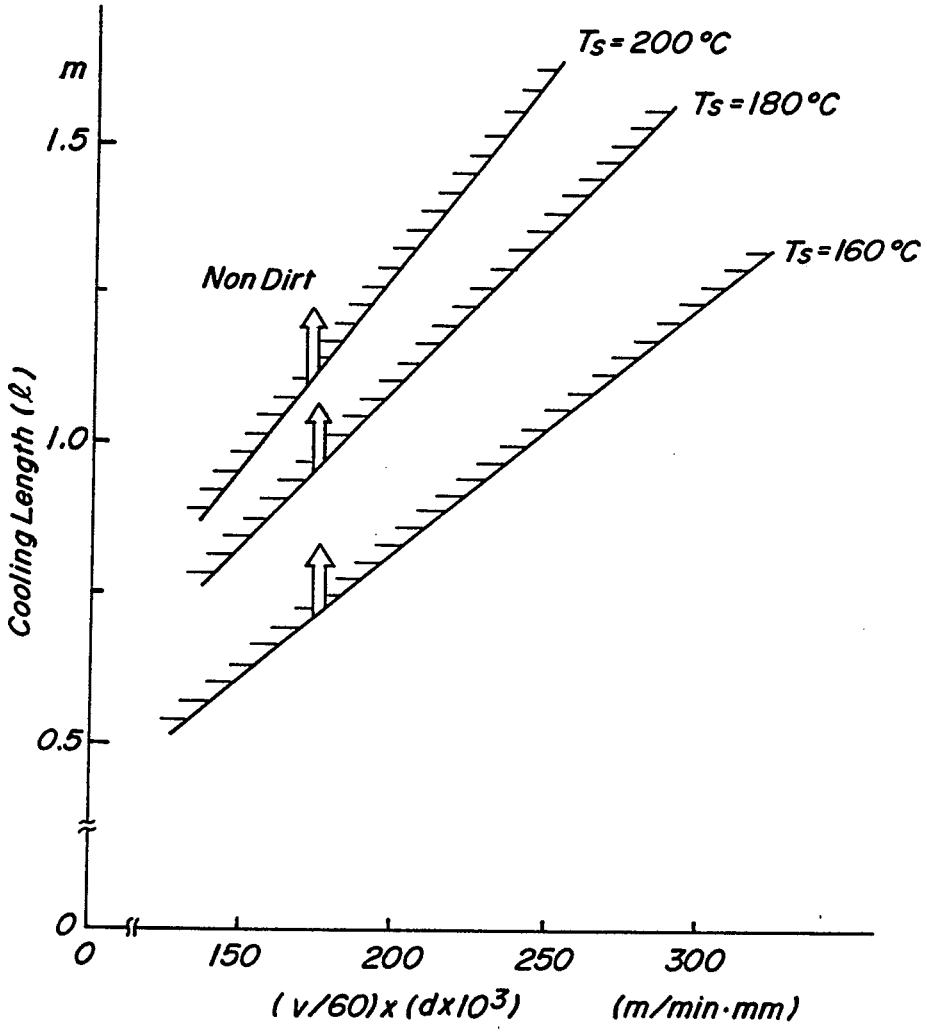
FIG. 2 is a graph showing conditions preventing dirt adhesion in the relation between the cooling length and the product of the line speed and the thickness of strip $(v/60)(d\times10^3)$.

FIG. 2 is a graph showing conditions preventing dirt adhesion in the relation between the cooling length (l) and the product of the line speed and the thickness of strip $(v/60)(d\times10^3)$ when in the formula (3) the specific heat of the steel strip (Cp) and the temperature of cooling water (Tw) are constant in 0.124 Kcal/kg°C. and 80° C., respectively, and the product of the line speed and the thickness of strip is varied in a range of 135 to 300.

In FIG. 2, the zones shown by hatches are preferable operation condition ranges at the temperature of steel strip (Ts) at inlet of the cooling tank and the dirt adhesion can be perfectly prevented when the cooling is effected under such preferable operation condition.

Figure 3:
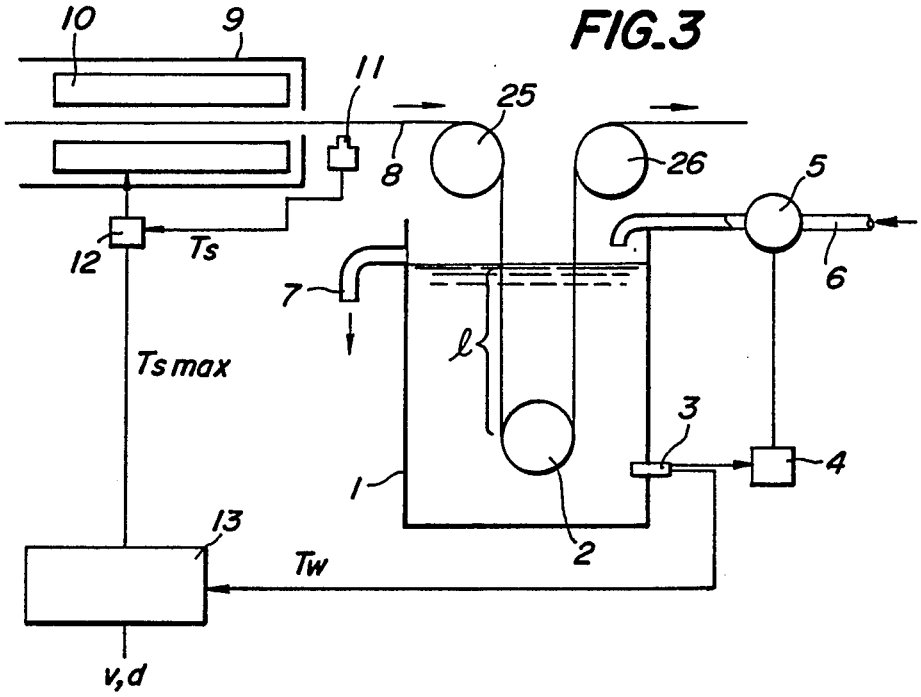
FIGS. 3, 4, 5 and 6 are diagrammatic views of embodiments of the invention.

FIG. 3 shows an embodiment of an apparatus for cooling the steel strip according to the invention. In FIG. 3, a cooling water tank 1 is provided with a sink-roll 2 arranged in the cooling water to guide a steel strip 8 passing through the cooling water from an inlet guide roll 25 at the inlet of the cooling tank to an outlet guide roll 26.

There is a sensor 3 on the wall of the cooling tank 1 for detecting the temperature (Tw) of the cooling water. The sensor 3 is connected to a controller 4 for controlling the temperature of the cooling water, which controller supplies an output signal to a pump 5 when the temperature of the cooling water exceeds a predetermined temperature to supply cooling water to the cooling tank 1 through a cooling water supply pipe 6 while to overflow hot water from the cooling tank through an overflow pipe 7.

A processing unit 13 for operating according to the above formula is connected to the sensor 3 to receive the signal of the detected temperature (Tw) of cooling water in the cooling tank 1. The processing unit 12 is also connected to another central processing unit (not shown) to receive signals of the line speed (v) and the thickness of strip (d) and is input with another informations such as the cooling length (l) from the surface 22 of the cooling water to the first sink-roll 2 and the specific heat of strip (Cp) as constants. The detected temperature (Tw) of cooling water is used together with the speed (v) and thickness (d) of steel strip to operate a processing unit 13 according to the above formula (3) to determine the maximum allowable temperature of steel strip (Ts)max at the inlet of the cooling tank. This calculated inlet temperature (Ts)max of steel strip is transmitted to a temperature controller 12 and compared with an actual inlet temperature of steel strip detected by means of a steel strip temperature sensor 11. An output signal from the temperature controller 12 is used to control cooling means 10 in a cooling zone 9 so as to limit the upper limit of the actual inlet temperature (Ts) of steel strip in respect to the calculated inlet temperature (Ts)max.

Figure 4:
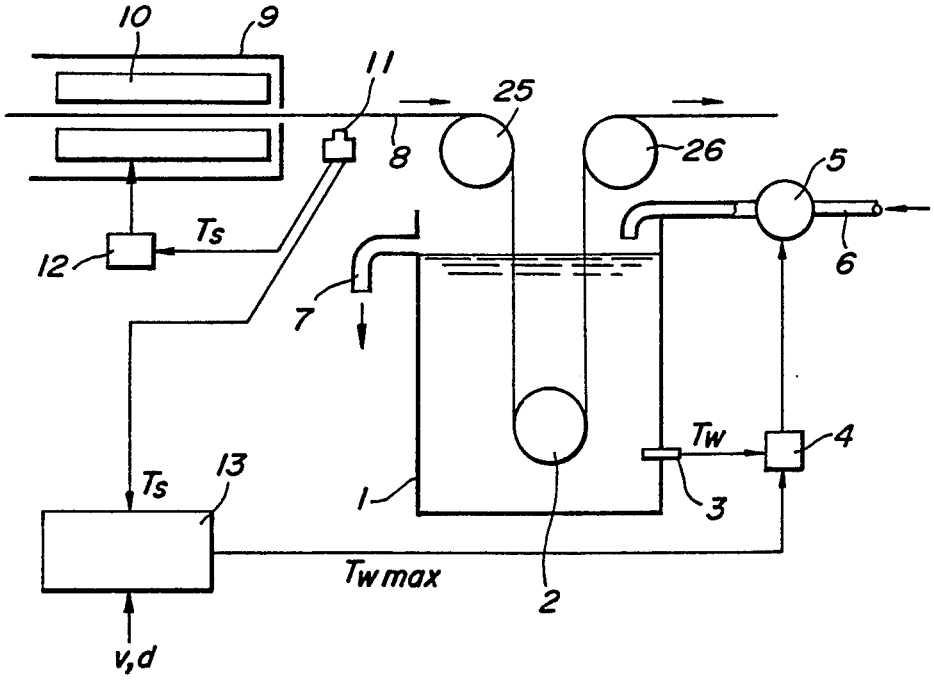

FIG. 4 shows an embodiment for controlling a temperature (Tw) of cooling water in the cooling tank 1.

In this embodiment, the temperature of strip (Ts) at the inlet of the cooling tank is detected by the temperature sensor 11 and transmitted to the processing unit 13. This unit 13 operates according to the above formula (3) to determine the maximum allowable temperature of cooling water (Tw)max. Thus determined temperature (Tw)max is transmitted to the temperature controller 4 and compared with an actual temperature of cooling water (Tw) in the tank detected by the temperature detecting sensor 3 in the controller 4. An output signal from this controller 4 is supplied to the pump 5 when the temperature of the cooling water (Tw) exceeds the maximum allowable temperature (Tw)max to supply cooling water to the cooling tank 1.

Figure 5:
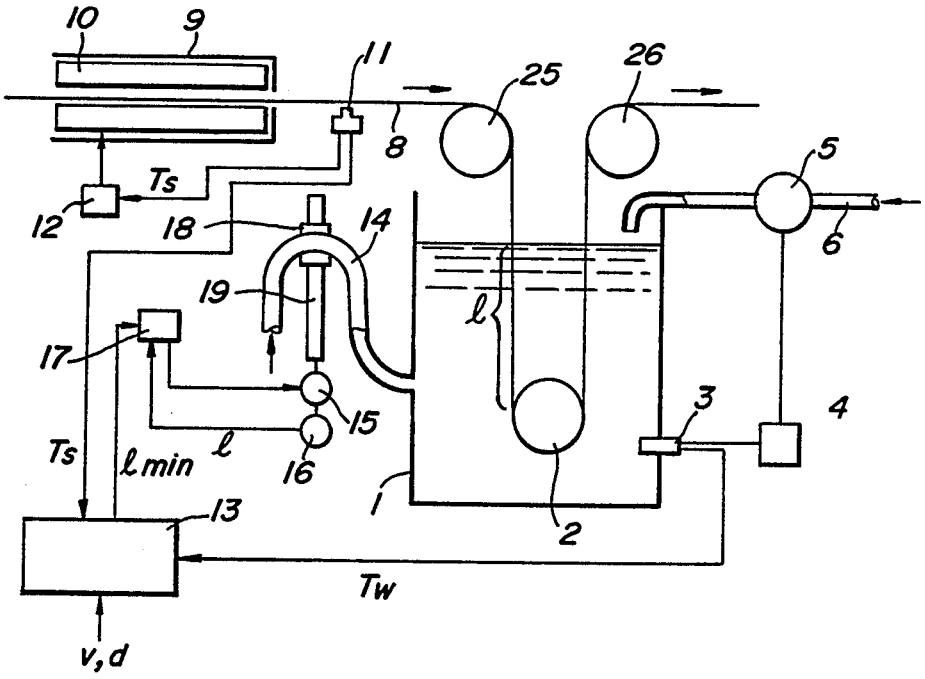

FIG. 5 shows an embodiment for controlling the cooling length (l). The installation shown in FIG. 5 comprises a flexible hose 14, a driving motor 15 for moving the hose 14 vertically, a position sensor 16, a position controller 17, a hose supporting member 18 and a driving shaft 19.

In this embodiment, the inlet temperature of strip (Ts) and the temperature of cooling water (Tw) detected by the temperature sensors 11 and 13, respectively, are transmitted to the processing unit 13. This unit 13 operates according to the above formula (3) to determine the minimum allowable cooling length (l)min. This determined cooling length (l)min is transmitted to the position controller 17 to adjust the position of the flexible hose 14 vertically corresponding to the minimum allowable cooling length (l)min.

Figure 6:
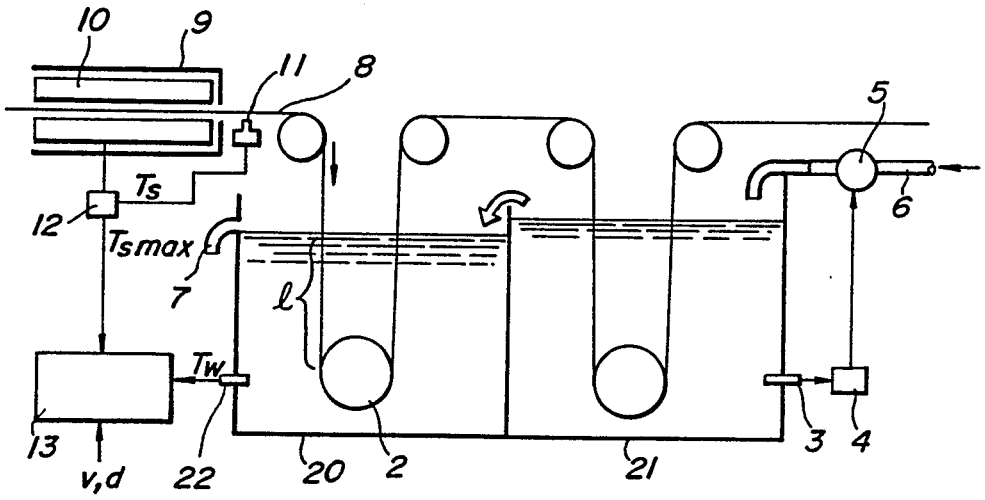

FIG. 6 shows another embodiment comprising two cooling tanks 25 and 26. In this embodiment, the temperature of cooling water in the first and second cooling tanks 25 and 26 are detected by temperature sensors 22 and 3, respectively. The temperature of cooling water in the second cooling tank 21 is controlled such that a target temperature is obtained by passing the steel strip 7 through both of the first cooling tank 20 and the second cooling tank 21. The cooling water in the second cooling tank 21 overflows into the first cooling tank 20 and the water in the tank 20 is overflowed through a discharge pipe 7 to be recovered as hot water.

In this case, the temperature of cooling water (Tw) of the first cooling tank 20 and the cooling length (l) can not be controlled, but the inlet temperature of strip (Ts) can be controlled by using the temperature of cooling water (Tw) detected by the temperature sensor 22 so as to prevent the dirt adhesion as the embodiment shown in FIG. 3.

EXAMPLE

There will be described a typical example of the invention referring to the embodiment shown in FIG. 4. A steel strip having a thickness of 0.5 to 1.5 mm and a width of 900 to 1,400 mm was cooled by immersing in the cooling water. The temperature of the cooling water (Tw) was controlled at 80° C. and the cooling length (l) was 1.2 meters. The product of the speed of steel strip (v/60) m/min and the strip thickness ($d \times 10^3$) mm and the temperature of the steel strip (Ts) at the inlet of the cooling tank were varied and the condition of dirt on the surface of the steel strip after final cooling was investigated.

Figure 7:
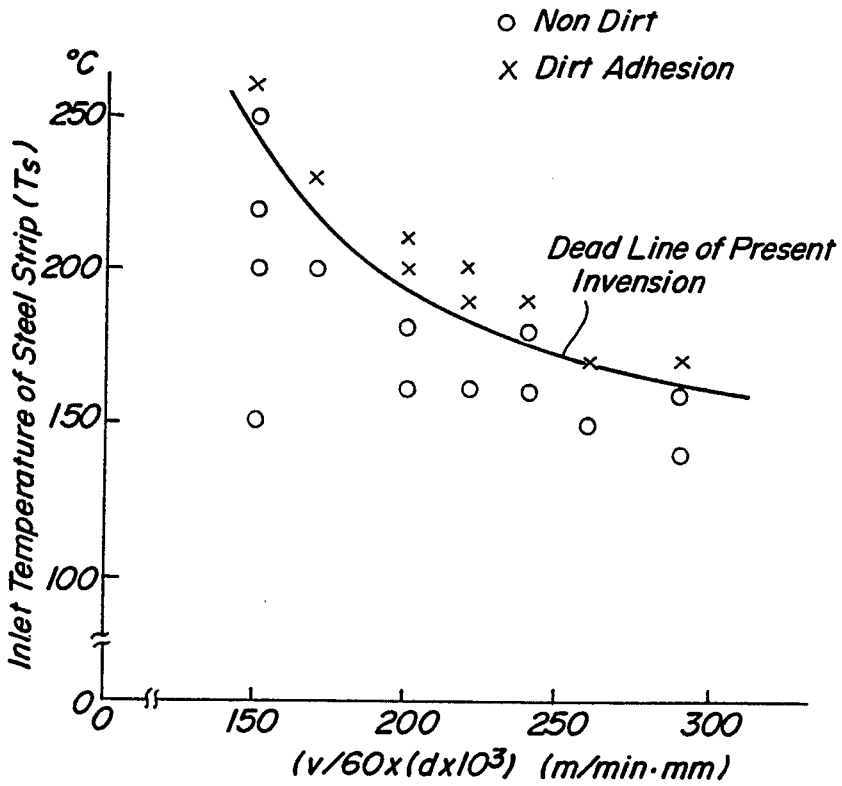
FIG. 7 is a graph showing the dead zone of dirt adhesion.

FIG. 7 is a graph showing the dead zones of dirt adhesion obtained as a result of the investigation. The dead lines of the dirt adhesion shown in FIG. 7 are identical with the dead lines calculated according to the above formula (3) in respect to a condition that the specific heat of the steel strip (Cp) is 0.124 Kcal/kg°C., the temperatre of cooling water (Tw) is 80° C. and the cooling length (l) is 1.2 meters.

It can be seen that according to the present invention, in the final cooling process of the continuous heat treating line wherein the steel strip is immersed in cooling water in the cooling tank, any dirt adhesion on the surface of the strip caused by contacting with the sink-roll is perfectly prevented.

What is claimed is:

1. A method of cooling a steel strip which has been cooled through a final cooling zone in a continuous heat treating line comprising step of finally cooling by immersing the steel strip in cooling water within a cooling tank and passing the steel strip around one or more sink-rolls immersed in the cooling water, wherein cooling of the steel strip immersed in the cooling water prior to reaching to the first sink-roll is controlled to be cooled to such a low temperature as to prevent evaporation of a water film interposed between the surface of the first sink-roll and the surface of the strip around the first sink-roll by controlled cooling in accordance with the following formula:

$$l \geqq \frac{\rho \cdot Cp \cdot v \cdot d}{2\alpha} \, l_n \left( \frac{Ts - Tw}{120 - Tw} \right)$$

here, l is the cooling length from the surface of the cooling water to the sink-roll (m)

Ts is the temperature of the steel strip at the inlet of the cooling tank (°C.)

Tw is the temperature of the cooling water (°C.)

Cp is the specific heat of the steel strip (Kcal/kg°C.)

v is the feed speed of the steel strip (m/hr)

d is the thickness of the steel strip (m)

$\alpha$ is the coefficient of heat transfer (Kcal/m hr°C.)

$\rho$ is the density of the steel strip (kg/m$^3$).

2. The method as claimed in claim 1, wherein the cooling length (l) is controlled in accordance with the formula.

3. The method as claimed in claim 1, wherein the temperature of the steel strip at the inlet of the cooling tank (Ts) is controlled in accordance with the formula.

4. The method as claimed in claim 1, wherein the temperature of cooling water (Tw) is controlled in accordance with the formula.

* * * * *